US006649074B2

(12) United States Patent
Lee et al.

(10) Patent No.: US 6,649,074 B2
(45) Date of Patent: Nov. 18, 2003

(54) BUBBLE-JET TYPE INK-JET PRINT HEAD AND MANUFACTURING METHOD THEREOF

(75) Inventors: Chung-jeon Lee, Seoul (KR); Jae-ho Moon, Seoul (KR); O-keun Kwon, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 233 days.

(21) Appl. No.: 09/835,348

(22) Filed: Apr. 17, 2001

(65) Prior Publication Data

US 2002/0008733 A1 Jan. 24, 2002

(30) Foreign Application Priority Data

Jul. 20, 2000 (KR) ..... 2000-41747

(51) Int. Cl.[7] ..... B41J 2/16
(52) U.S. Cl. ..... 216/27; 216/46
(58) Field of Search ..... 216/27, 46; 438/21

(56) References Cited

U.S. PATENT DOCUMENTS 5,519,424 A * 5/1996 Scardovi et al. ..... 347/65
5,871,656 A * 2/1999 Silverbrook ..... 216/27
6,171,510 B1 * 1/2001 Lee ..... 216/27
6,267,904 B1 * 7/2001 Silverbrook ..... 216/27
6,276,057 B1 * 8/2001 Aihara et al. ..... 29/890.1
6,462,391 B1 * 10/2002 Chong et al. ..... 257/419
2001/0048454 A1 * 12/2001 Westberg et al. ..... 347/61

FOREIGN PATENT DOCUMENTS

JP 05-338178 12/1993

OTHER PUBLICATIONS

"Notice to Submit response" issued by Korean Intellectual Property Office dated on Apr. 29, 2003.

* cited by examiner

*Primary Examiner*—Anita Alanko
(74) *Attorney, Agent, or Firm*—Robert E. Bushnell, Esq.

(57) ABSTRACT

A bubble-jet type ink jet printhead and manufacturing method thereof are provided. In the printhead, a manifold for supplying ink and a concave ink chamber is integrated with a substrate by being recessed from the same surface of the substrate, and a nozzle palate on the substrate in which a nozzle is formed and a round-shaped heater surrounding the nozzle are integrated without a complex process such as bonding. Thus, this simplifies the manufacturing procedure and facilitates high volume production. Furthermore, the round-shaped heater forms a doughnut-shaped bubble to eject ink, thereby preventing a back flow of ink as well as formation of satellite droplets which may degrade image resolution.

22 Claims, 20 Drawing Sheets

BUBBLE-JET TYPE INK-JET PRINT HEAD AND MANUFACTURING METHOD THEREOF

CLAIM OF PRIORITY

This application makes reference to, incorporates the same herein, and claims all benefits accruing under 35 U.S.C. §119 from my application entitled BUBBLE-JET TYPE INK-JET PRINTHEAD AND MANUFACTURING METHOD THEREOF filed with the Korean Industrial Property Office on Jul. 20, 2000 and there duly assigned Ser. No. 2000/41747.

BACKGROUND OF THE INVENTION

1. Field of the Invention

The present invention relates to an ink-jet printhead, and more particularly, to a bubble-jet type ink-jet printhead and manufacturing method thereof.

2. Description of the Related Art

The ink ejection mechanisms of an ink-jet printer are largely categorized into two types: an electro-thermal transducer type (bubble-jet type) in which a heat source consisting of resistive heating elements is employed to form a bubble in ink causing ink droplets to be ejected, and an electro-mechanical transducer type in which a piezoelectric crystal bends to change the volume of ink causing ink droplets to be expelled.

An ink-jet printhead having this bubble-jet type ink ejector needs to meet the following conditions. First, a simplified manufacturing procedure, low manufacturing cost, and high volume production must be offered. Second, to produce high quality color images, creation of satellite droplets that trail ejected main droplets must be prevented. Third, when ink is ejected from one nozzle or ink is refilled into an ink chamber after ink ejection, cross-talk with adjacent nozzles from which no ink is ejected must be prevented. To this end, a back flow of ink in the opposite direction of a nozzle must be avoided during ink ejection. Another heater shown in FIGS. 1A and 1B is provided for this purpose. Fourth, for a high speed print, a cycle beginning with ink ejection ending with ink refill must be as short as possible.

However, the above conditions tend to conflict with one another, and furthermore the performance of an ink-jet printhead is closely associated with the construction of an ink chamber, ink channel, and heater, types of formation and expansion of bubbles, and the relative size of each element.

In efforts to overcome problems with the above requirements, ink-jet print heads having a variety of structures have been proposed in U.S. Pat. Nos. 4,339,762; 4,882,595; 5,760,804; 4,847,630; and 5,850,241, European Patent No. 317,171, and Fan-Gang Tseng, Chang-Jin Kim, and Chih-Ming Ho, "A Novel Micoinjector with Virtual Chamber Neck', IEEE MEMS '98, pp. 57–62. However, ink-jet printheads proposed in the above patents and literature may satisfy some of the aforementioned requirements but not completely provide an improved ink-jet printing approach. Thus, further improvements for an ink-jet printhead remain to be required.

SUMMARY OF THE INVENTION

To solve the above problems, it is an objective of the present invention to provide a bubble-jet type ink jet printhead having a structure for satisfying the aforementioned requirements.

It is another objective of the invention to provide a method of manufacturing an ink jet printhead having a structure for satisfying the aforementioned requirements.

It is further an object of the present invention to produce numerous nozzle ejectors on a substrate, wherein an ink manifold supplies ink to each ink ejector by either having ink chambers that join with the manifold or having an ink channel etched in the substrate to carry ink from the manifold to the ink chamber for ejection.

It is further an object of the present invention to provide both anisotropic etching and isotropic etching to achieve the ink jet structures presented in the present invention.

It is further an object of the present invention to provide bubble guides and droplet guides for each nozzle;

It is further an object of the present invention to provide for a hemispherical and an ellipsoid ink chamber for each nozzle;

It is also an object of the present invention to provide circular or elliptical heaters to match the shape of the ink chamber.

Accordingly, to achieve the above objectives, the present invention provides a bubble-jet type ink jet printhead including a substrate integrated with a manifold for supplying ink and an ink chamber, both of which are recessed from the same surface of the substrate, a nozzle plate in which a nozzle is formed, a heater consisting of resistive heating elements, and electrodes for applying current to the heater. The ink chamber connects with the manifold and is a space filled with ink to be ejected. The shape thereof is substantially hemispherical.

The nozzle plate is stacked on the substrate and covers the manifold and the ink chamber. A nozzle is formed at a position corresponding to he center portion of the ink chamber. The heater having a ring shape surrounds the nozzle on the nozzle plate. Furthermore, the ink chamber is directly connected to the manifold or else the ink channel is disposed therebetween. The cross-section of the ink channel is elliptic.

A bubble guide and a droplet guide extending in the depth direction of the ink chamber from the edges of the nozzle is formed for guiding the direction in which the bubble grows and the direction in which an ink droplet is ejected during ink ejection. Furthermore, the heater has a "C" or "O" shape so that the bubble may be substantially doughnut-shaped.

The present invention also provides a method of manufacturing bubble-jet type ink jet printhead. According to the manufacturing method, a substrate is etched from the surface of the substrate to form an ink chamber and a manifold, thereby integrating the ink-jet printhead with the substrate. More specifically, an insulating layer is formed on the surface of a substrate and a ring-shaped heater and electrodes for applying current to the heater are formed on the insulating layer. The insulating layer is etched to form a opening for an ink chamber having a diameter less than that of the ring-shaped heater and a opening for a manifold on the inside and outside of the heater, respectively; The exposed substrate by the etched insulating layer is etched to form an ink chamber which is of a diameter greater than that of the ring-shaped heater and is substantially hemispherical in shape and a cylindrical manifold. A protective layer in which a nozzle is formed at a location corresponding to the center portion of the ink chamber is deposited over the entire surface of the substrate to cover the manifold.

An anisotropic etch is first performed on the substrate exposed by the etched insulating layer by a predetermined depth and then an isotropic etch is performed on the substrate thereby forming cylindrically shaped ink chamber and manifold. Between the steps of etching the insulating layer and the substrate, an etch mask exposing the opening for an ink chamber is formed on the insulating layer. The substrate exposed by the etch mask and the insulating layer is anisotropically etched by a predetermined depth to form a hole. A spacer is formed along a sidewall of the hole. In this way, a bubble guide and a droplet guide extending in the depth direction of the ink chamber from the edges of the nozzle are formed. The opening for an ink chamber is elliptic, so the ink chamber is substantially cylindrical and the cross-section thereof is elliptic.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1A:
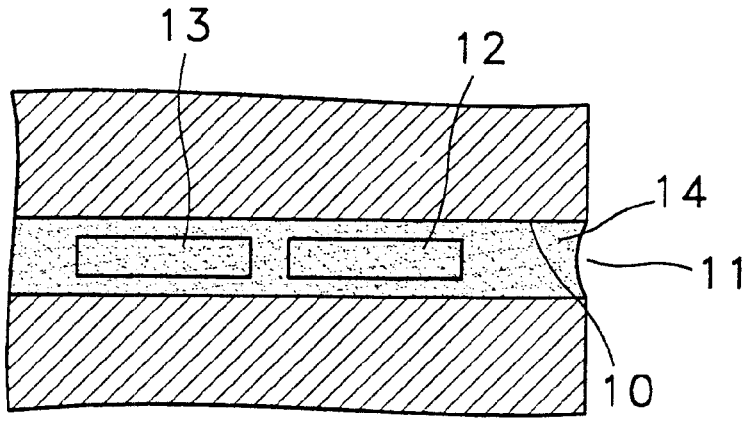
FIGS. 1A and 1B are cross-sectional views illustrating a structure of a bubble-jet ink jet printhead along with an ink ejection mechanism.
Figure 1B:
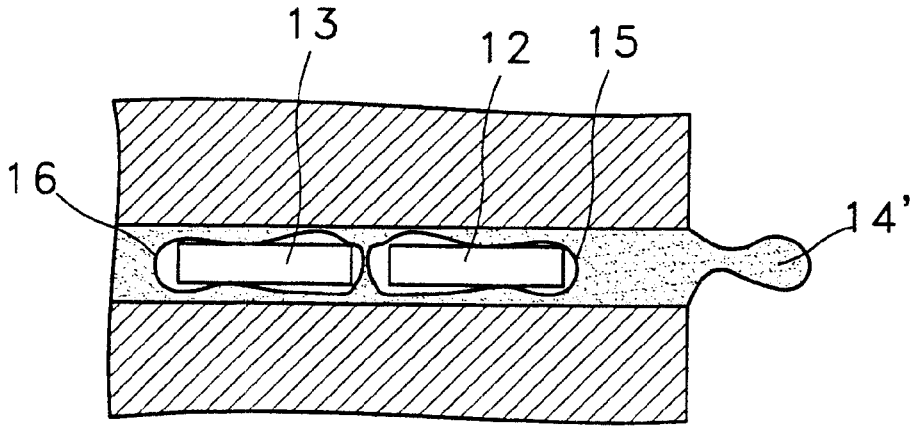

Referring to FIGS. 1A and 1B, a bubble-jet type ink ejection mechanism will now be described. When a current pulse is applied to a heater 12 consisting of a resistive heating elements formed in an ink channel at which a nozzle 11 is located, heat generated by the heater 12 heats ink 14 to form bubbles 1, which causes ink droplets 14' to be ejected.

Figure 2:
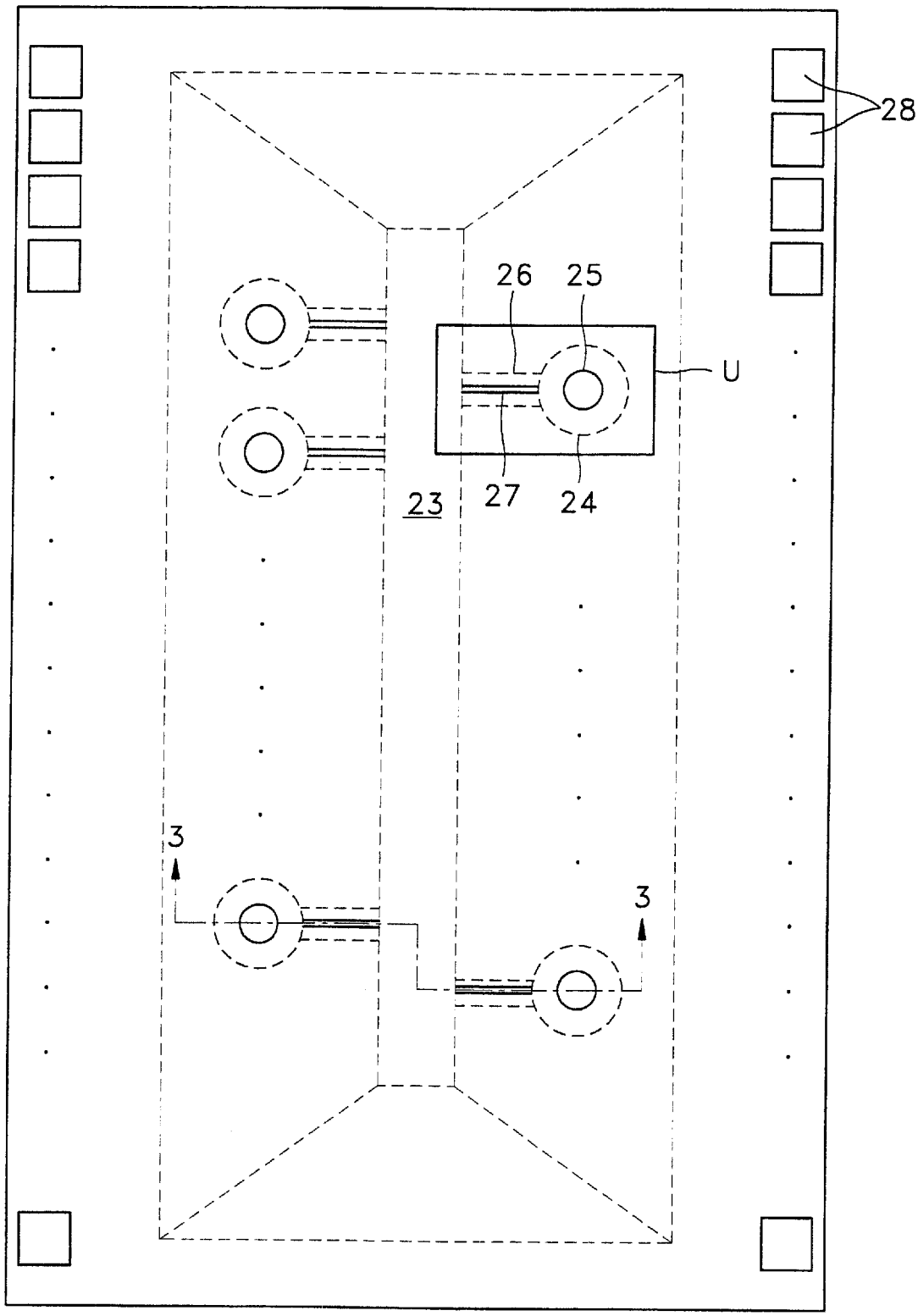
FIG. 2 is a schematic plan view showing an example of a bubble-jet type ink jet printhead in which donut-shaped bubbles are formed to eject ink.
Figure 3:
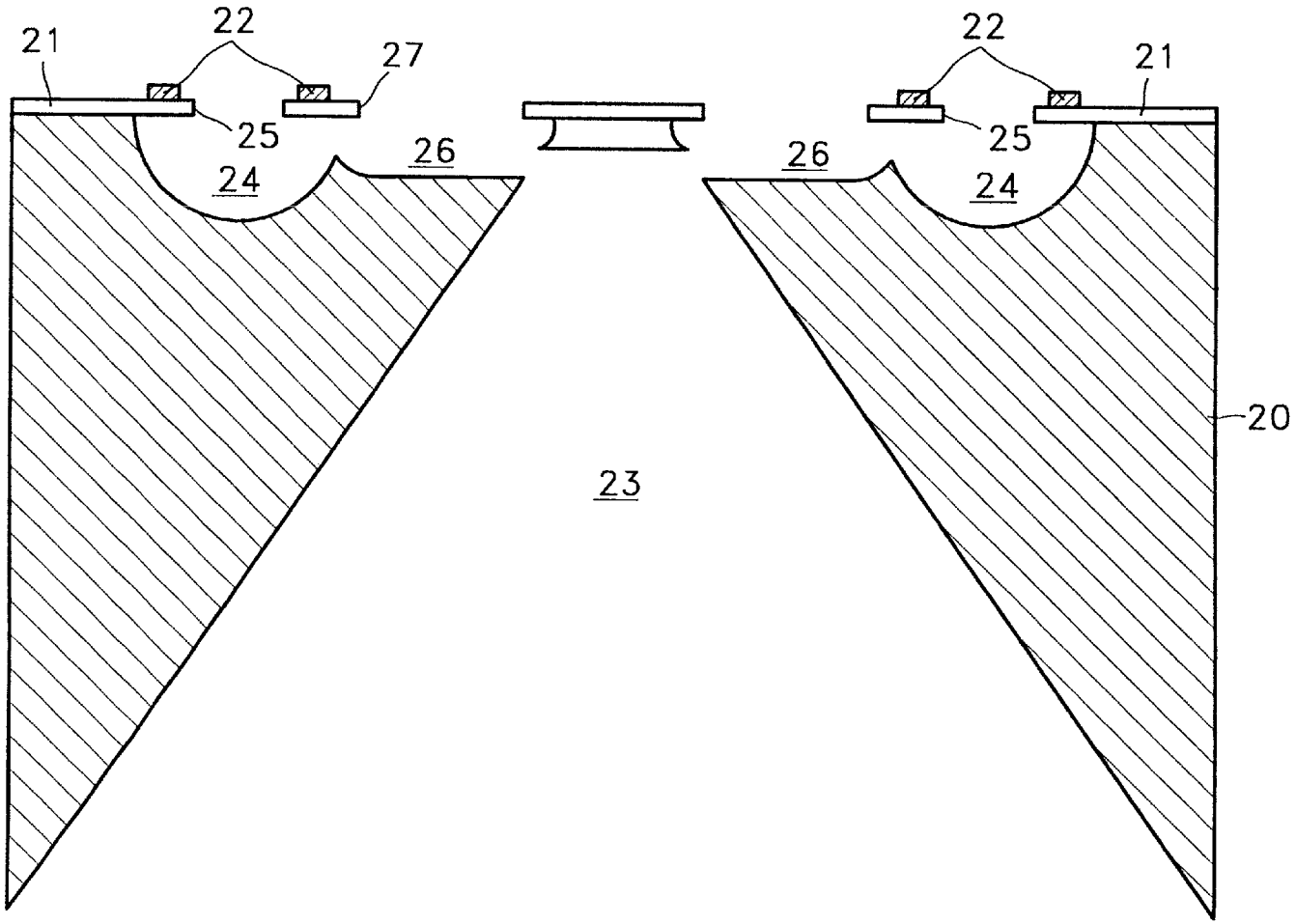
FIG. 3 is a cross-sectional view taken along line 3—3 of FIG. 2.

Before describing embodiments of the present invention, a print head shown in FIGS. 2 and 3 will now be described. The print head shown in FIGS. 2 and 3 are disclosed in Korean Patent Application No. 2000-22260. In the print head shown in FIGS. 2 and 3, ink ejectors U are arranged in two rows in zig zag on either side of a manifold 23 etched from a rear surface of a substrate 20, and bonding pads 28 electrically connecting with each ink injector U are formed allowing leads of a flexible printed circuit board (PCB) to be bonded. Furthermore, the manifold 23 connects with an ink feed inlet (now shown) of an ink supply containing ink.

Each ink ejector U includes a substantially hemispherical ink chamber 24 and an ink channel 26 for connecting the ink chamber 24 with the manifold 23, both of which are etched from the surface of the substrate 20 to be integrated with the substrate 20. The ink chamber 24 is covered by a nozzle plate 21 stacked on the substrate 20 excluding a nozzle 25. A ring-shaped heater 22 consisting of resistive heating elements is formed on the nozzle plate 21. Here, the ink chamber 24 and the ink channel 26, respectively, are formed by an isotropic etch of the substrate 20 using the nozzle 25 and the nozzle plate 21 as an etch mask.

Thus configured printhead creates a donut-shaped bubble like that according to the present invention and facilitates high volume production to meet the above all requirements for an ink jet printhead, but there remains a need for improvement. For example, since the manifold 23 of the printhead shown in FIGS. 2 and 3 is formed by etching the thick substrate 20, this not only requires much time to cause productivity drops, but also makes the center portion of the printhead so thin that it is mechanically weak to shock to break easily. The present invention provides the structure of a printhead for improving such problems and manufacturing method thereof.

Figure 4:
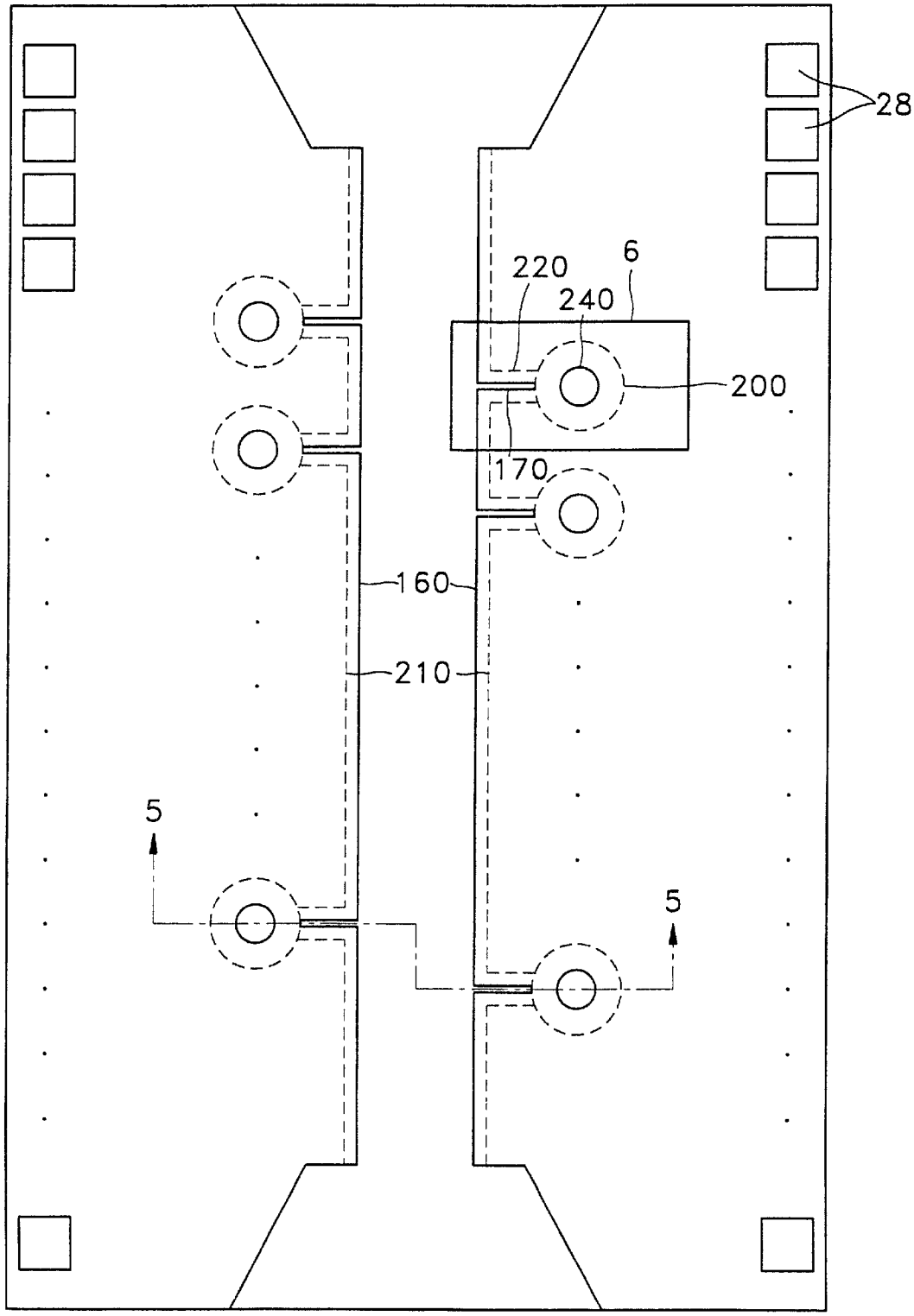
FIG. 4 is a schematic plan view showing a bubble-jet type ink jet printhead according to a first embodiment of the present invention.
Figure 5:
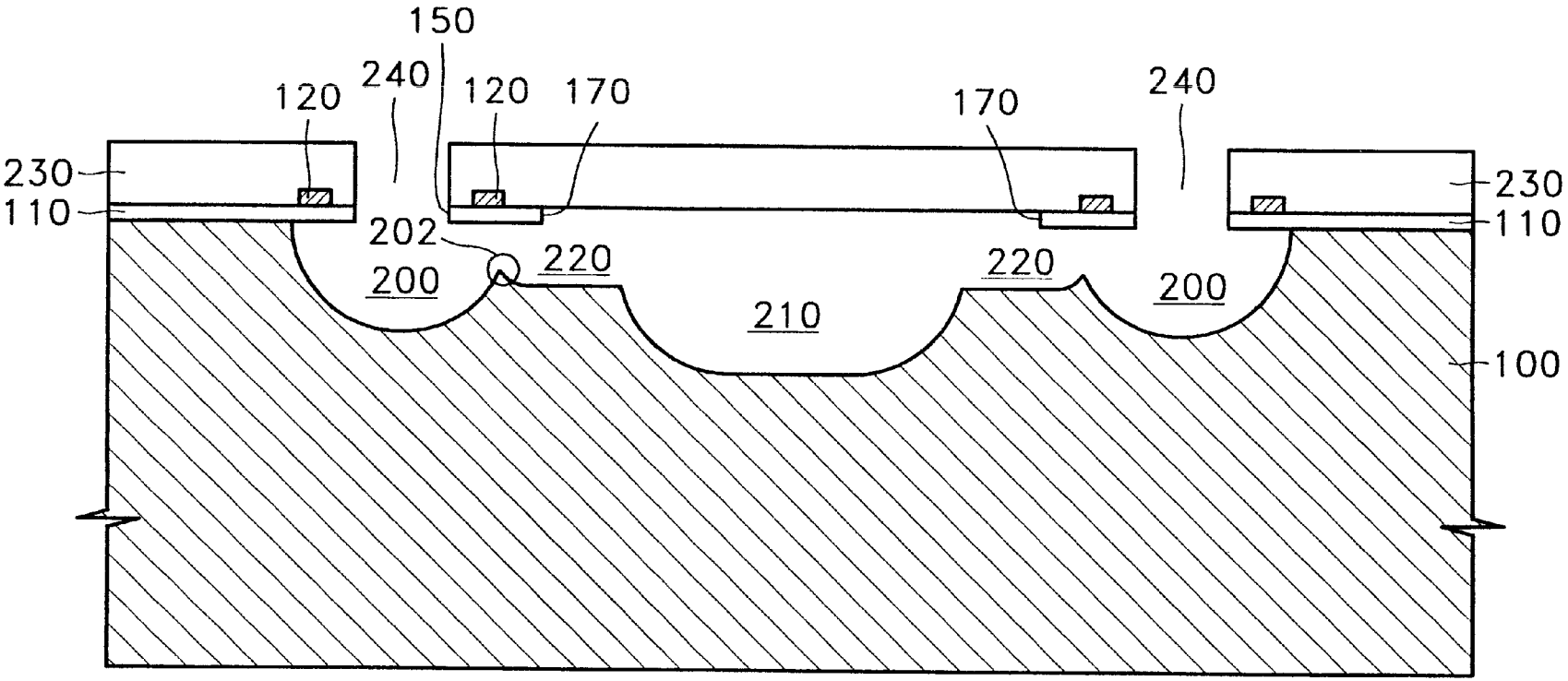
FIG. 5 is a cross-sectional view taken along line 5—5 of FIG. 4.

Referring to FIGS. 4 and 5, on a printhead according to a first embodiment of the invention, ink ejectors 6 are arranged in two rows in zig zag on either side of a substantially cylindrical manifold 210 recessed from the surface of a substrate 100, and bonding pads 28 electrically connecting with each ink ejector 6 and on which leads of a flexible PCB are bonded are arranged. Furthermore, the manifold 210 connects with an ink feed inlet (not shown) of an ink supply containing ink at the side of the printhead (vertical direction of FIG. 4).

The ink ejectors 6 in FIG. 4 are arranged in two rows, but may be arranged in one row, or in more than three rows for resolution enhancement. Furthermore, the printhead using a single color of ink is shown as FIG. 4, but three or four groups of ink ejectors may be arranged by the number of colors for color printing.

Each ink ejector 6 includes a substantially hemispherical ink chamber 200, and an ink channel 220 formed shallower than the ink chamber 200 for connecting the ink chamber 200 with the manifold 210, both of which are recessed from the surface of the substrate 100 to be integrated with the substrate 100 Furthermore, a bubble keeping portion 202, which prevents a bubble from being pushed back into the ink channel 220 when the bubble expands, projects out slightly toward the surface of the substrate 100 at a point where the ink chamber 200 and the ink channel 220 meet each other. An insulating layer 110, in which a opening 150 for an ink chamber, a opening 160 for a manifold, and a opening 170 for an ink channel are formed at locations corresponding to the center portions of the ink chamber 200, the manifold 210, and the ink channel 220, respectively, is formed on the substrate 100. A ring-shaped heater 120 (See FIG. 6A) consisting of resistive heating elements is formed on the insulating layer 110. An electrode (125 of FIG. 6A) for applying heater driving current is coupled to the heater 120. A protective layer 230, on which a nozzle 240 is formed, is stacked on the heater 120 and the insulating layer 110 to cover the opening 160 for a manifold and the opening 170 for an ink channel. Here, the insulating layer 110 and the protective layer 230 may be collectively called a nozzle plate.

The substrate 100 is made of silicon, and the insulating layer 110 is comprised of a silicon oxide layer formed by oxidation of the surface of the silicon substrate 100, or a silicon nitride layer deposited on the silicon substrate 100. The heater is comprised of a polycrystalline silicon ("polysilicon") doped with impurities or a Ta—Al alloy. The protective layer 230 composed of a polyimide film also serves as a flexible PCB on which a power supply for driving each ink ejector 6 and a wiring line are provided.

Figure 6A:
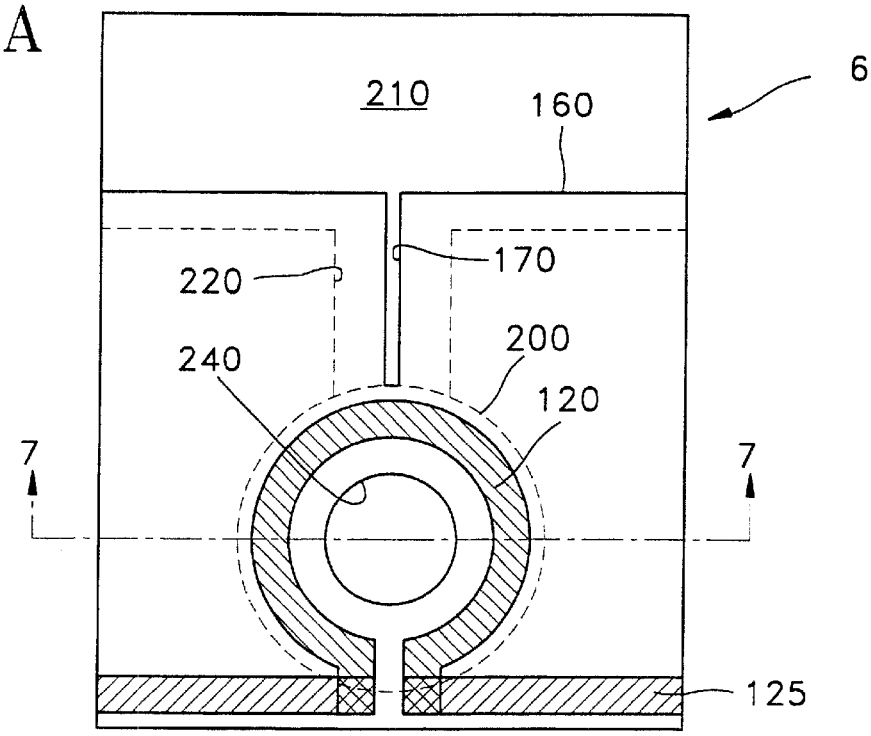
FIG. 6A is a plan view showing the unit ink ejector of FIG. 4.
Figure 6B:
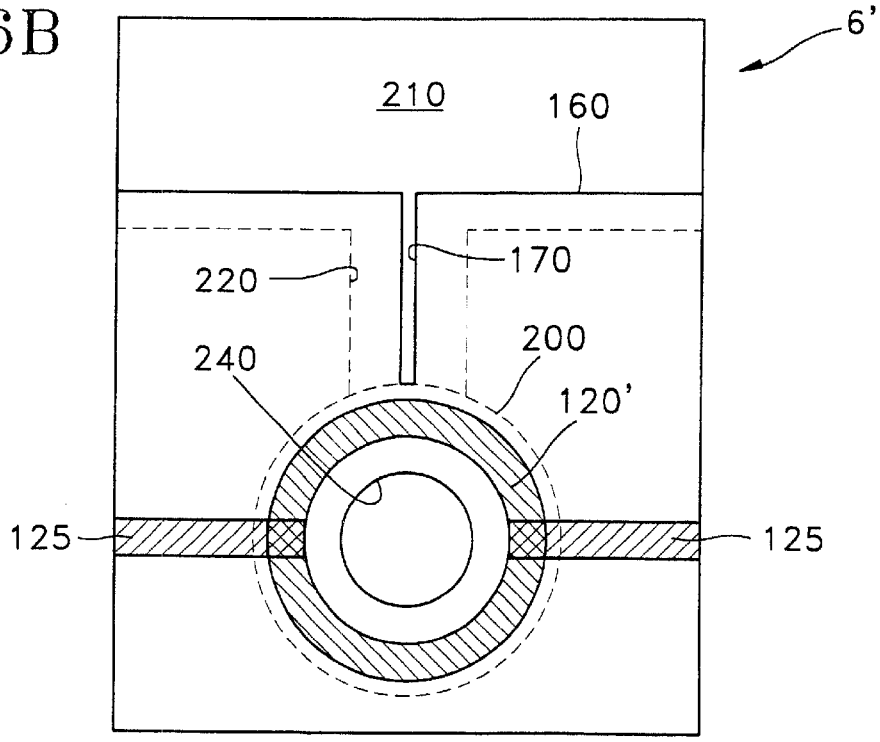
FIG. 6B is a plan view showing an modified example of the unit ink ejector of FIG. 4.
Figure 7A:
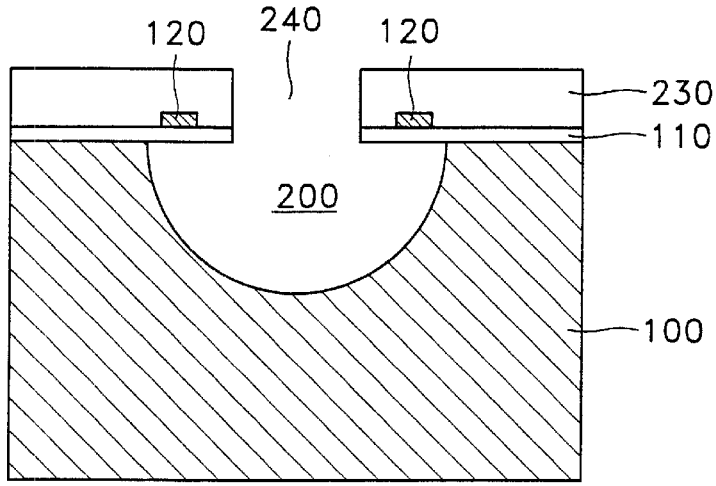
FIGS. 7A and 7B are cross-sectional views taken along line 7—7 of FIG. 6A according to a first embodiment of the present invention.
Figure 7B:
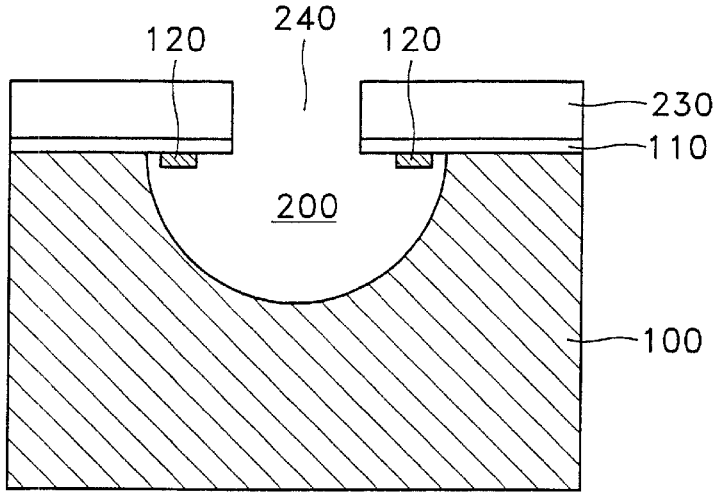
Figure 7C:
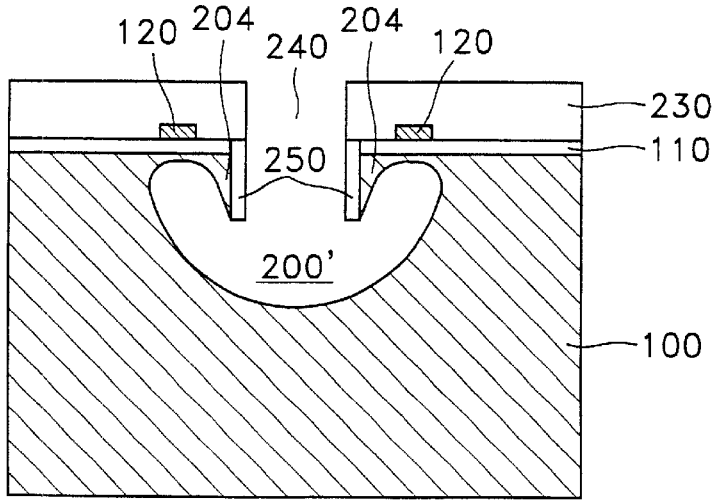
FIG. 7C is a cross-sectional view taken along line 7—7 of FIG. 6A according to a second embodiment of the present invention.

FIGS. 6A and 6B are plan views magnifying the ink ejector 6 according to the first embodiment of the invention, and FIGS. 7A–7C are cross-sectional views showing the structure of ink chambers 200 and 200' according to the first and second embodiments of the invention taken along line 7—7 of FIG. 6A. Referring to FIGS. 6A–7C, the structure of the ink ejector 6 according to the embodiments of the invention will now be described.

First, the ink chamber 200 filled with ink to be ejected is formed in a hemispherical shape on the surface of the substrate 100. The ring-shaped heater 120 or 120' is provided on the insulating layer 110, of which the heater 120 of FIG. 6 is substantially "C"-shaped which is open along ends which are coupled to the electrodes 125. The electrode 125 is comprised of Al or Al alloy which has a good conductivity and facilitates deposition and patterning, and electrically connected to the bonding pad (28 of FIG. 4). The heater 120' of FIG. 6B, which a modified example, has substantially closed "O"-shape whose opposite ends are coupled to the electrodes 125. That is, the heater 120 shown in FIG. 6A is serially coupled between the electrodes 120, whereas the heater 120' shown in FIG. 6B is parallel coupled therebetween. The heater 120 or 120' maybe formed under an insulating layer 110 as shown in FIG. 7B.

A printhead according to a second embodiment of the invention shown in FIG. 7C is different from the first embodiment in the structure of an ink chamber 200' and a nozzle 240. That is, the bottom surface of the ink chamber 200' is substantially spherical like the ink chamber 200 of the first embodiment, and at the top portion are formed a droplet guide 250 extending from the edges of the nozzle 240 toward the ink chamber 200' and a bubble guide 204 formed under the insulating layer 110 near the droplet guide 250 and on which a substrate material is slightly left. Functions of the droplet guide 250 and the bubble guide 204 will later be described.

Figure 8A:
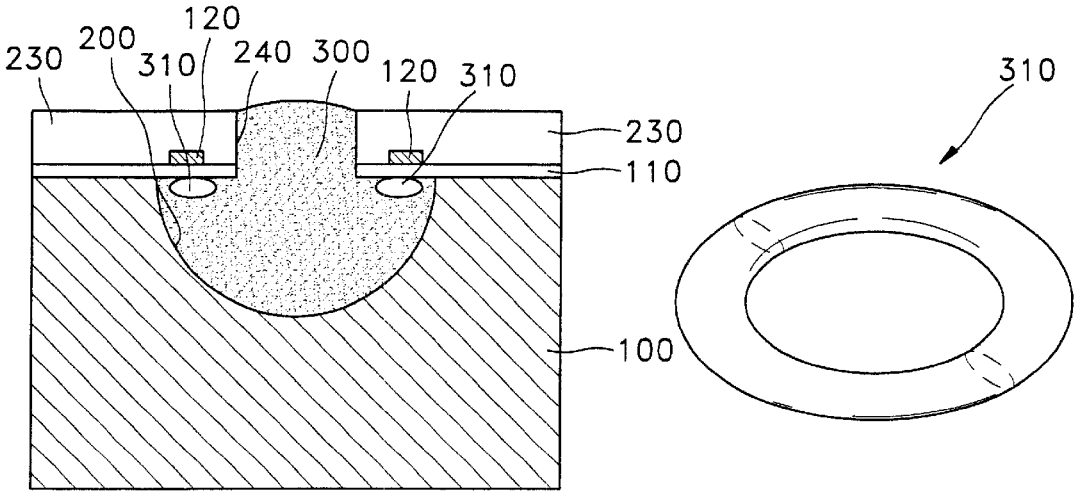
FIGS. 8A and 8B are cross-sectional views for explaining a mechanism for ejecting ink from the ink ejector of the printhead of FIG. 7A according to a first embodiment of the present invention.
Figure 8B:
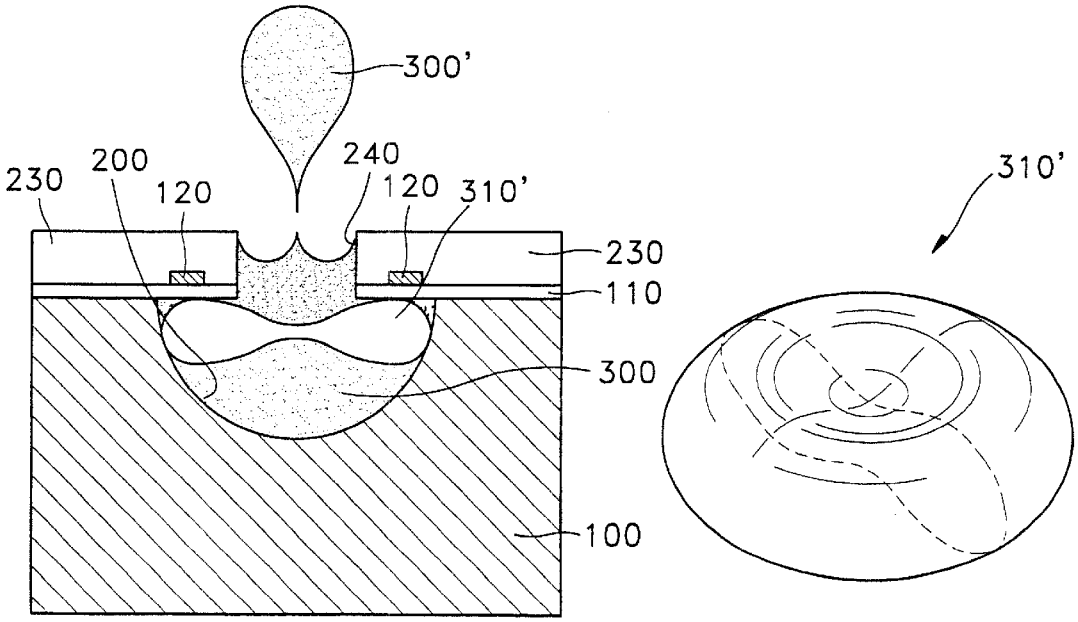

The function and effect of thus constructed ink jet printheads according to the first and second embodiments will now be described in conjunction with ink ejection mechanism thereof. FIGS. 8A and 8B are cross-sectional views showing an ink ejection mechanism of the printhead according to the first embodiment of the invention. As shown in FIG. 8A, if pulse-phase current is applied to the ring-shaped heater 120 in a state in which the ink chamber 200 is filled with ink 300 supplied through the manifold 210 and the ink channel 220 by capillary action, then heat generated by the heater 120 is delivered through the underlying insulating layer 110 and the ink 300 under the heater boils to form a bubble 310. The bubble 310 is approximately doughnut-shaped conforming to the ring-shaped heater 120 as shown in the right side of FIG. 8A.

If the doughnut-shaped bubble 310 expands with the lapse of time, as shown in FIG. 8B, the bubble 310 coalesces under the nozzle 240 to form a substantially disk-typed bubble 310', the center portion of which is concave. At the same time, ink droplet 300' within the ink chamber 200 is ejected by the expanded bubble 310' If the applied current shuts off, the heater 120 and the ink chamber 200 are cooled to contract or burst the bubble 310, and then ink 300 refills the ink chamber 200.

According to the ink ejection mechanism of the printhead according to the first embodiment of the invention, since the ink chamber 200 is closed except for a connection path with the ink channel 220, the expansion of the bubble 310 or 310' is limited within the ink chamber 200 to prevent a back flow of the ink 300, so that cross-talk does not occur between adjacent ink ejectors. Furthermore, as shown in FIG. 5, the bubble keeping portion 202 formed at a point where the ink chamber 200 and the ink channel 220 meet is very effective in preventing the bubble itself 310 or 310' from being pushed toward the ink channel 220. Furthermore, the doughnut-shaped bubble coalesces to cut off the tail of the ejected ink 300' preventing the formation of the satellite droplets.

Figure 9A:
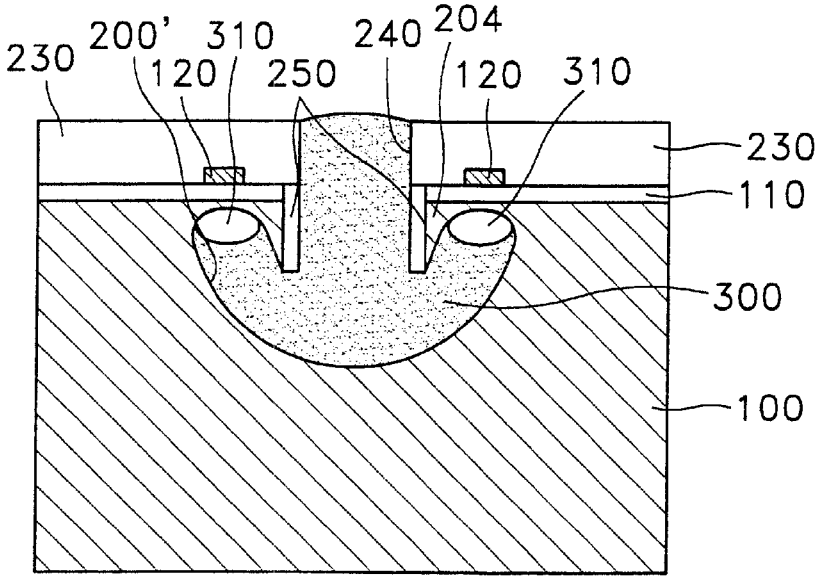
FIGS. 9A and 9B are cross-sectional views for explaining a mechanism for ejecting ink from the ink ejector of FIG. 7C according to a second embodiment of the present invention.
Figure 9B:
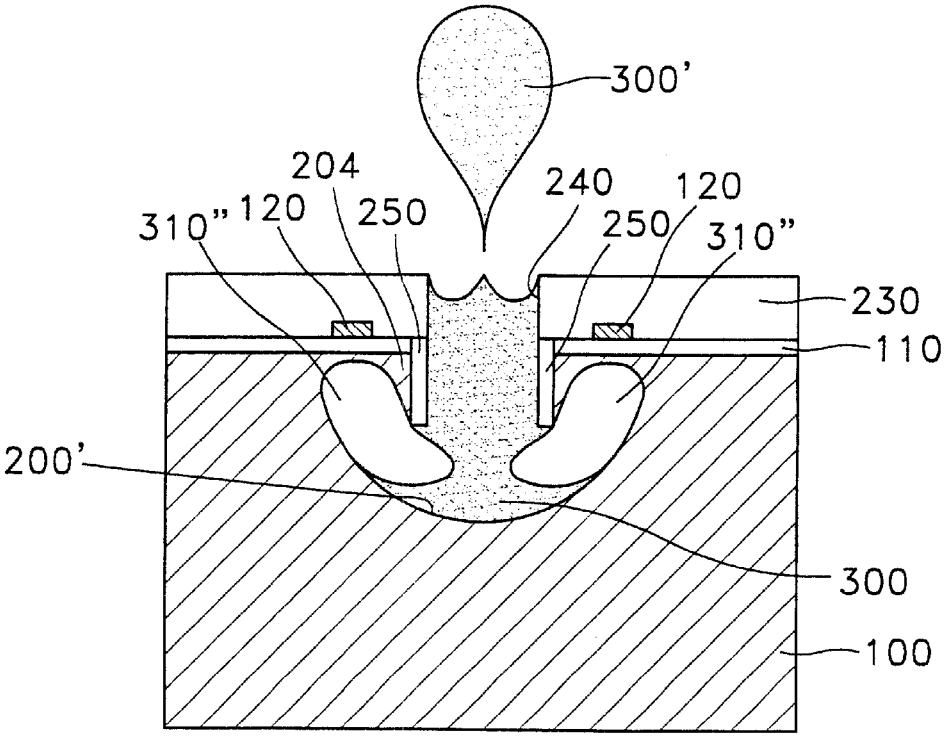

FIGS. 9A and 9B are cross-sectional views showing the ink ejection mechanism of the printhead according to the second embodiment of the invention. The difference between the ink ejection mechanisms of the printheads according to the first and second embodiments will now be described. First, a bubble 310" will hardly expands below ink chamber 200' to merge under the nozzle 240 due to the bubble guide 204. However, the possibility that the expanded bubble 300" merges under the nozzle 240 may be controlled by controlling the length of the droplet guide 250 and the bubble guide 204 extending downward. The ejection direction of the ejected droplet 300' is guided by the droplet guide 250 extending downward from the edges of the nozzle 240 to be exactly perpendicular to the substrate 100.

Figure 10:
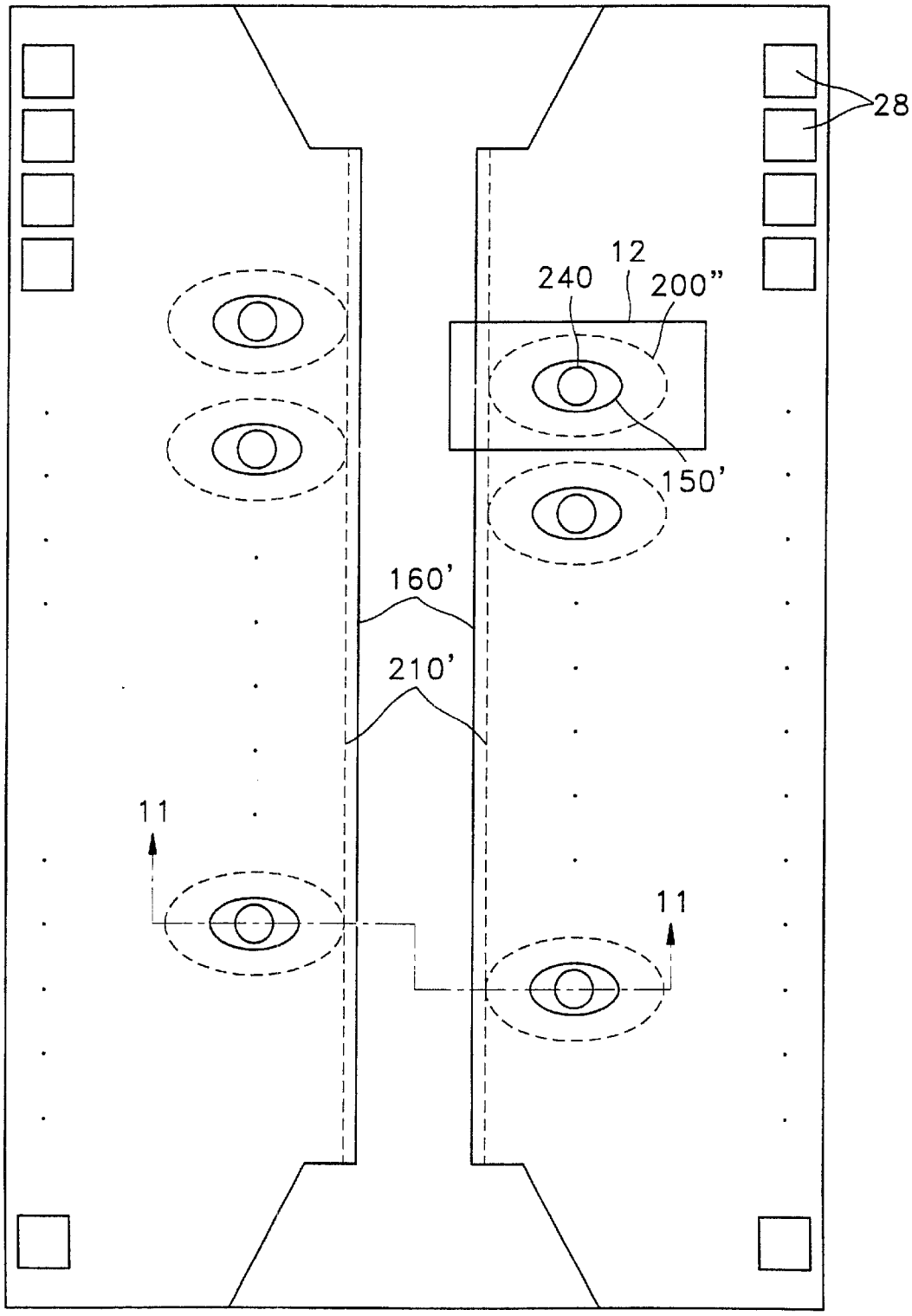
FIG. 10 is a schematic plan view showing a bubble-jet type ink jet print head according to a third embodiment of the present invention.
Figure 11:
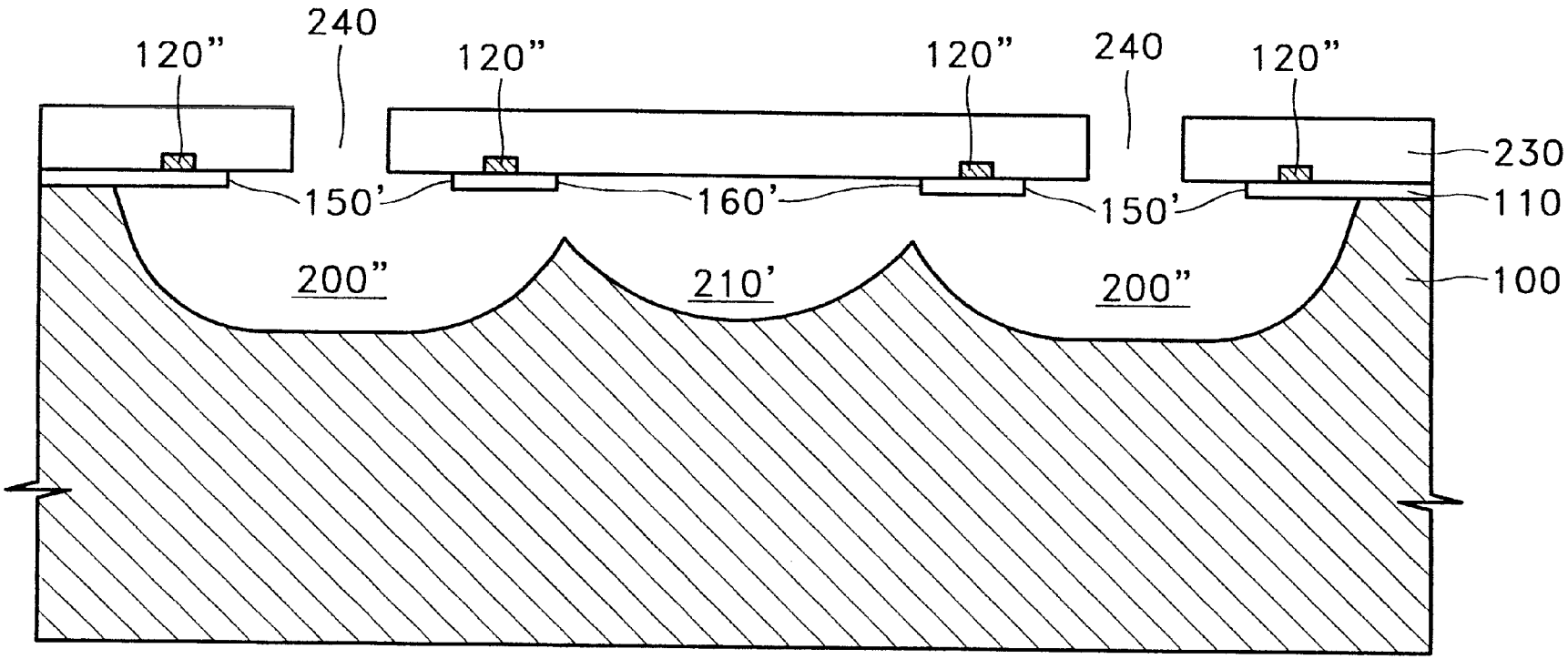
FIG. 11 is a cross-sectional view taken along line 11—11 of FIG. 10.
Figure 12:
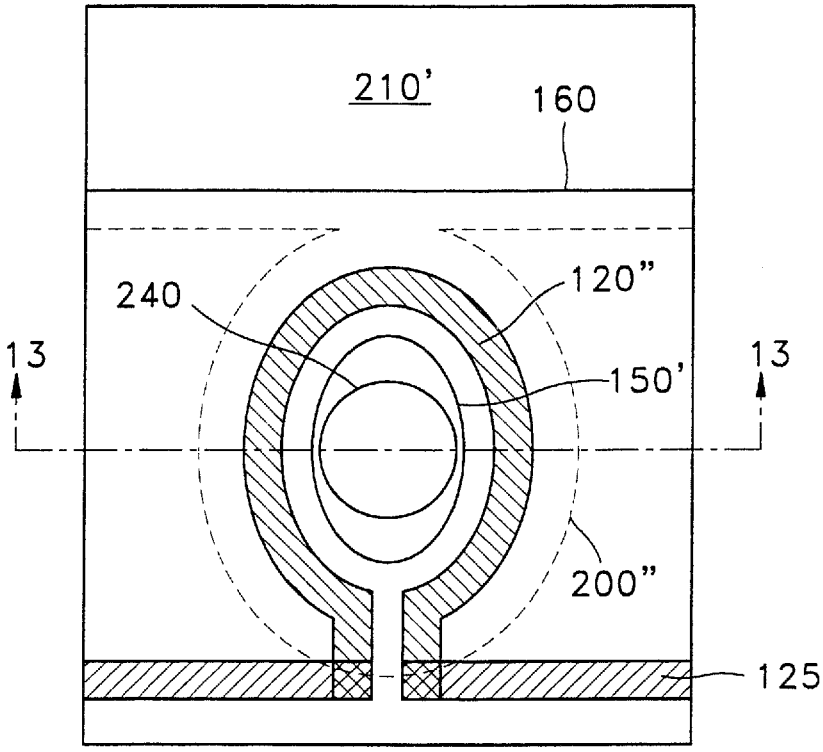
FIG. 12 is a plan view showing the unit ink ejector of FIG. 10.
Figure 13:
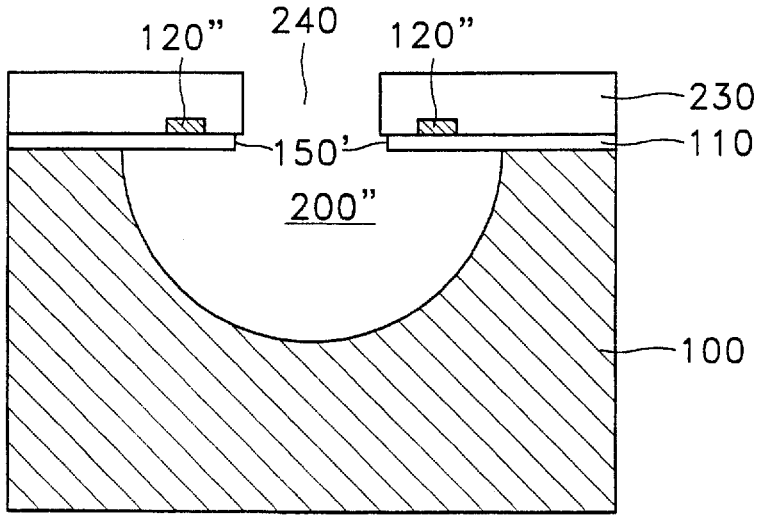
FIG. 13 is a cross-sectional view taken along line 13—13 of FIG. 12.

FIG. 10 is a schematic plan view showing the structure of a bubble-jet type ink jet printhead according to a third embodiment of the invention, and FIG. 11 is a cross-sectional view taken along line 11—11 of FIG. 10. FIG. 12 is a detailed plan view showing the unit ink ejector 12 of FIG. 12, and FIG. 13 is a cross-sectional view taken along line 13—13 of FIG. 12. The structure of a printhead shown in FIGS. 10–13 will now be described focusing on its difference with the printheads according to the first and second embodiments.

First, in the printhead according to the third embodiment of the invention, an ink chamber 200" is connected directly to a manifold 210' without the ink channel (220 of FIGS. 4 and 5) of the first embodiment. Thus, no opening (170 of FIGS. 4 and 5) for an ink channel formed on the insulating layer 110 in the first embodiment is provided. Furthermore, the ink chamber 200' is basically hemispherical, but the cross section is elliptic and one side of the semimajor axis of the ellipse is directly connected with the manifold 210'. The ink chamber 200" does not need to have an elliptic cross section, but may have a circular cross-section as in the first embodiment of the invention. However, in the printhead according to this embodiment having no separate ink channel, the ink chamber 200" having an elliptic cross section prevents the width of the connection path between the manifold 210' and the ink chamber 200" from dramatically increasing if the width of the manifold 210' is irregular or two wide to exceed designed dimension. That is, in case of the elliptic cross section, changes in the radius of the cross-section (semicircle) cut along one side of the semimajor axis with respect to the cut positions are slight, thereby eventually providing a process margin. In an ink jet printer, considering that the width of an opening of an ink chamber corresponding to a connection path with an ink channel or a manifold, has a significant impact on various factors associated with the performance of the ink jet printer, such as a chamber internal pressure, uniformity of expanded bubble, back flow of ink into a manifold, ink ejection time, ink refill time, and overall drive frequency, it is highly desirable for the ink chamber 200" to have an elliptic cross section.

A heater 120" of this embodiment is elliptic conforming to the ink chamber 200" having an elliptic cross section. However, although the cross section of the ink chamber 200" is elliptic, it makes little difference if the heater 120" is ring-shaped. The only difference is that the elliptic heater 120" allows a bubble to more uniformly expand along the elliptic boundary of the ink chamber 200".

Furthermore, the shape and size of the opening (150 of FIG. 5) for an ink chamber is approximately equal to the shape and size of the nozzle 240 in the first embodiment, but in this embodiment it is not. That is, to form the ink chamber having an elliptic cross section, a opening 150' for an ink chamber on the insulating layer 110 is also elliptic in shape.

The remaining structures such as locations of the heater 120" and the insulating layer 110, serial/parallel coupling of the heater 120" and the electrodes 125, and the bubble guide (204 of FIG. 7C) and the droplet guide (250 of FIG. 7C) can be implemented in the same manner as in the aforementioned embodiments. Furthermore, formation and expansion of the elliptically doughnut-shaped bubble, and ink ejection mechanism associated therewith are similar to those in the above embodiments, and thus a detailed explanation will be omitted.

Figure 14A:
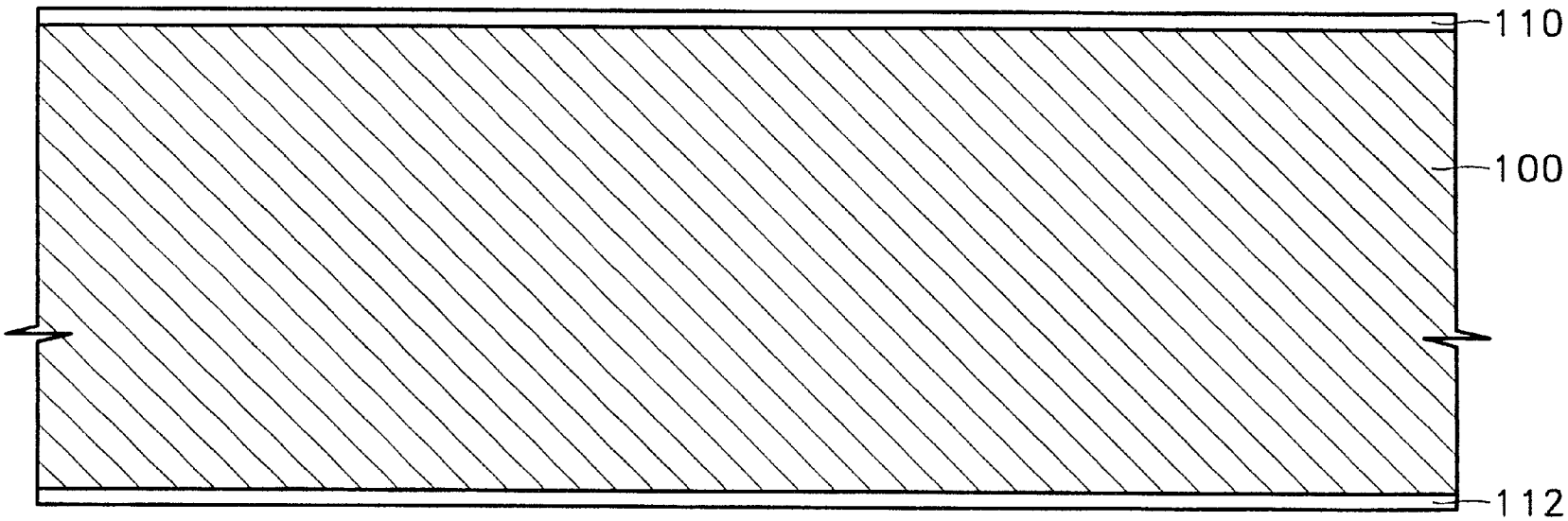
FIGS. 14A–14F are cross-sectional views showing a process of manufacturing a bubble-jet type ink jet printhead according to an embodiment of the present invention.

Next, a method of manufacturing an ink jet printhead according to a first embodiment of the present invention will now be described. FIGS. 14A–14F are cross-sectional views showing a process of manufacturing the printhead according to the first embodiment of the invention, taken along line 5—5 of FIG. 4. First, a substrate 100 is prepared. A silicon substrate having a thickness of 500 $\mu$m is used as the substrate 100 in this embodiment. This is because a silicon wafer widely used in the manufacture of semiconductor devices is employed to allow high volume production. Next, if the silicon wafer is wet or dry oxidized in a batch type or single wafer type oxidizing apparatus, as shown in FIG. 14A, the surface of the silicon substrate 100 is oxidized, thereby allowing a silicon oxide layer which is an insulating layer 110 to grow. A very small portion of the silicon wafer is shown in FIG. 14A, and a printhead according to the invention is formed by cutting tens to hundreds chips manufactured on a single wafer. Furthermore, as shown in FIG. 14A, the silicon oxide layers 110 and 112 are developed on both the front and rear surfaces of the substrate 100. This is because a batch type oxidizing furnace exposed to an oxidizing atmosphere is used on the rear surface of the silicon wafer as well. However, if a single wafer type oxidizing apparatus exposing only a front surface of a wafer is used, the silicon oxide layer 112 is not formed on the rear surface of the substrate 100. In FIGS. 14A–15B, a predetermined material layer is formed depending on the type of an apparatus. For convenience's sake, hereinafter it will be shown that a different material layer such a silicon nitride layer as will later be described is formed only on the front surface of the substrate 100.

Figure 14B:
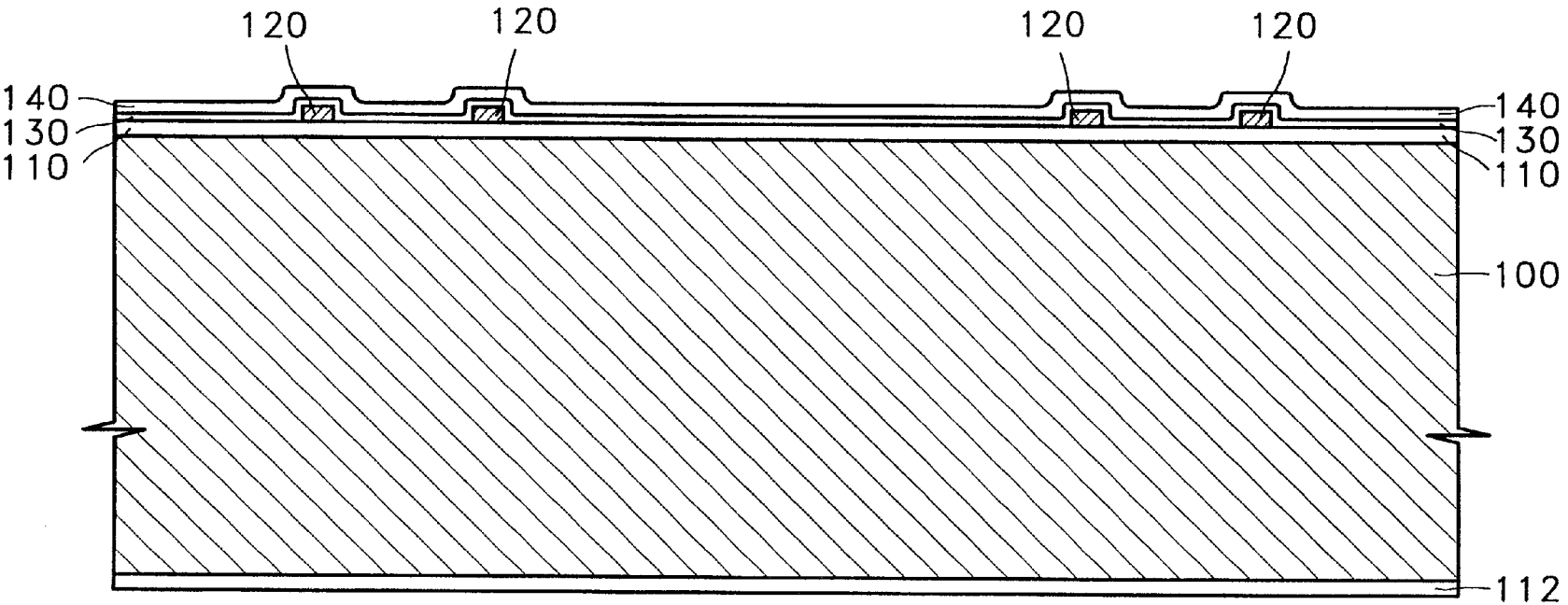

FIG. 14B shows a state in which a ring-shaped heater 120 and protective layers 130 and 140 have been sequentially formed. The ring-shaped heater 120 is formed by depositing polysilicon or a Ta—Al alloy over the insulating layer 110 to patterning the resultant material in a ring shape. Specifically, the polysilicon may be deposited to a thickness of about 0.7–1 $\mu$m by low pressure chemical vapor deposition (CVD), while the Ta—Al alloy may be deposited to a thickness of about 0.1–0.2 $\mu$m by sputtering which uses a Ta—Al alloy target or a multi-target of a Ta target and a Al target. The polysilicon layer or the Ta—Al alloy layer deposited over the insulating layer 110 is patterned by a photolithographic process using a photo mask and photoresist and an etching process of etching the polysilicon layer or the Ta—Al alloy layer using a photoresist pattern as an etch mask.

Subsequently, a silicon nitride layer 130 is deposited over the entire surface of the insulating layer 110, on which the ring-shaped heater 120 has been formed, as a heater protective layer. The silicon nitride layer 130 may be deposited to a thickness of about 0.5 $\mu$m by low pressure CVD. Then, although not shown, the silicon nitride layer 130 situated at the position where the heater 120 and the electrodes (125 of FIG. 6A) are coupled to each other is etched to form a contact hole. Next, a conductive metal such as Al or an Al alloy is deposited by sputtering on the heater 120 which exposes the position where the electrodes 125 is coupled and the silicon nitride layer 130 and patterned to form the electrode 125. The Al layer or the Al alloy layer is patterned to simultaneously form the bonding pads (28 of FIG. 4) at the end of a chip. Thus, the Al layer or the Al alloy layer is preferably deposited to a thickness of about 1 $\mu$m so that the bonding pads 28 can be later stably bonded to leads of a flexible PCB. A copper is employed as the electrode 125, in which case electroplating is preferably used. Next, as shown in FIG. 14B, a tetraethyleorthosilicate (TEOS) oxide layer 140 is deposited as a protective layer of the heater 120 and the electrodes 125. The TEOS oxide layer 140 may be deposited to a thickness of about 1 $\mu$m by CVD.

Meanwhile, although it has been described above that the electrodes 125 have been coupled to the heater 120 by the contact by interposing the silicon nitride layer 130, the electrodes 125 may be coupled directly to the heater 120, in which case either a silicon nitride layer or an oxide layer is formed on the electrodes 125 as a protective layer. Furthermore, the electrodes 125 may be formed interposing both the silicon nitride layer 130 and the TEOS oxide layer 140.

Figure 14C:
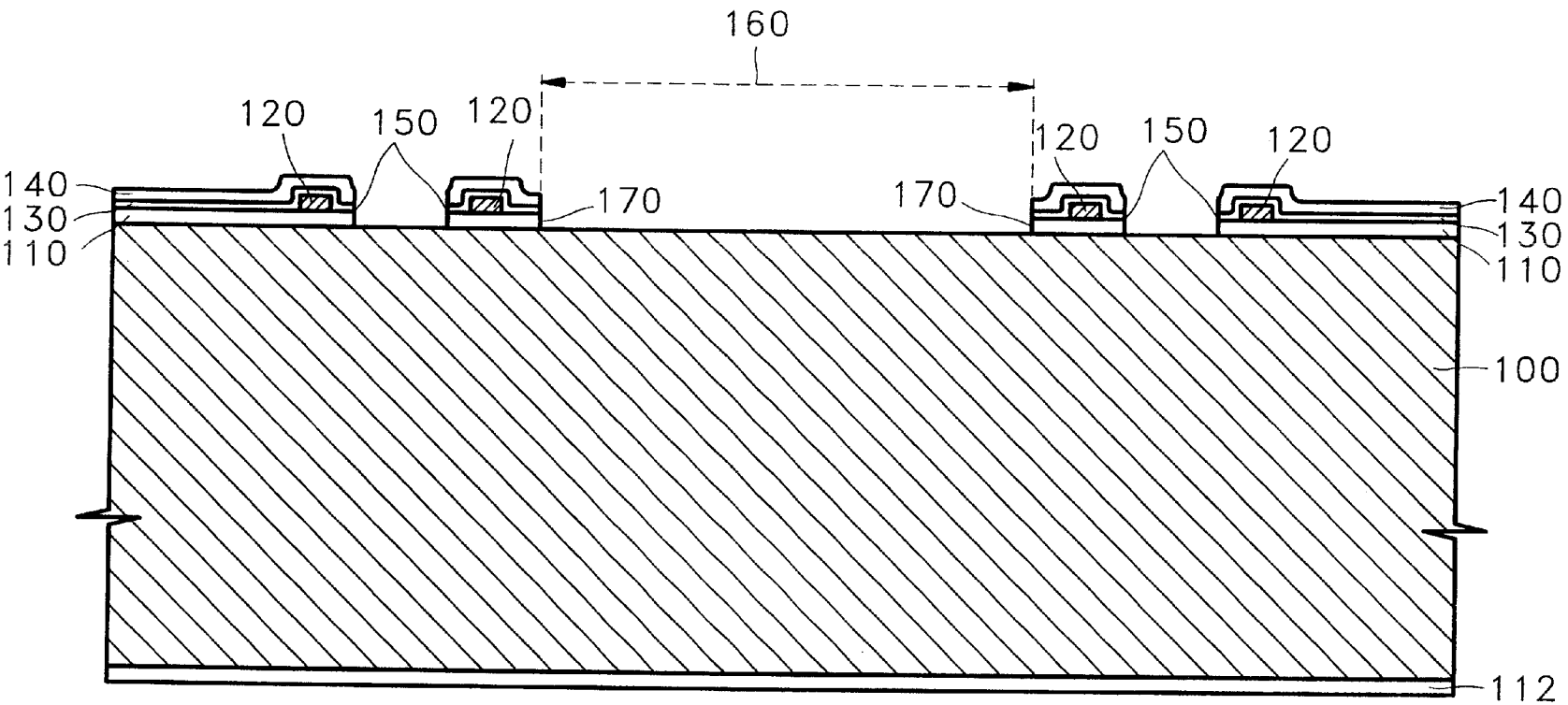

As shown in FIG. 14C, an opening 150 for an ink chamber having a diameter less than that of the ring-shaped heater 120, and an opening 160 for a manifold are formed on the inside and outside of the ring-shaped heater 120, respectively, and an opening 170 for an ink channel connecting with the opening 160 for a manifold outward the heater 120 is formed by pattern etching through the TEOS oxide layer 140, the silicon nitride layer 130, and the silicon oxide layer 110, respectively. Specifically, in a state in which the TEOS oxide layer 140 has been formed as shown in FIG. 14B, after forming an etch mask such as a photoresist pattern, which defines the opening 150 for an ink chamber, the opening 160 for a manifold, and the opening 170 for an ink channel, is formed on the TEOS oxide layer 140, the TEOS oxide layer 140, the silicon nitride layer 130, and the insulating layer 110 are sequentially etched to expose the substrate 100. The opening 150 for an ink chamber has a diameter of about 16–20 $\mu$m, the opening 170 for an ink channel has a width of about 2 $\mu$m, and the opening 160 for a manifold has a width of 160 $\mu$m–200 $\mu$m.

Figure 14D:
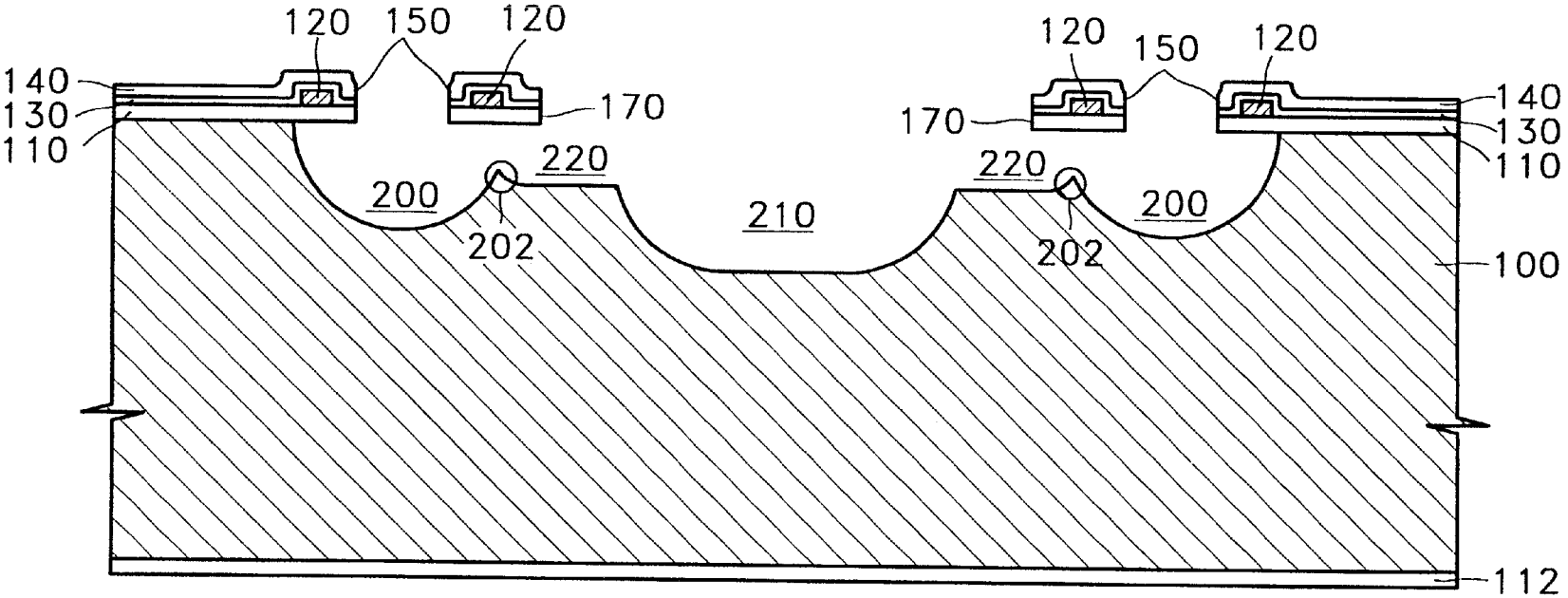

Next, as shown in FIG. 14D, the etch mask defining the openings 150, 160, and 170 is removed, followed by an isotropic etch of the exposed silicon substrate 100. Specifically, using $XeF_2$ as an etch gas, a dry etch is performed on the substrate 100 for a predetermined time, e.g., 15–30 minutes. Then, as shown in FIG. 14D, a substantially hemispherical ink chamber 200 with depth and radius of about 20 $\mu$m, a manifold 210 with a depth of 20–40 $\mu$m and a width of 500 $\mu$m–2 mm, and an ink channel with depth and radius of about 8 $\mu$m for connecting the ink chamber 200 and the manifold 210 are formed. Furthermore, a bubble keeping portion 202 projects at the connection portion where the ink chamber 200 and the ink channel 220 both being formed by etching meet.

Figure 14E:
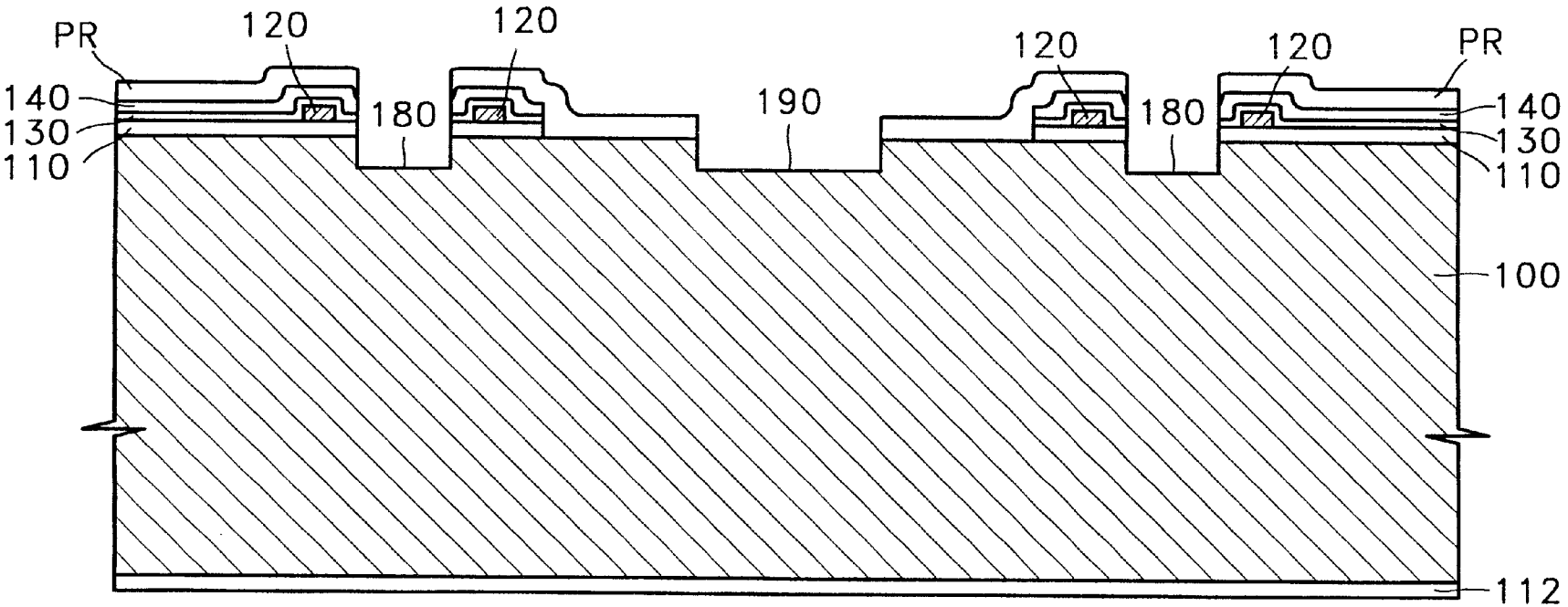

Meanwhile, the etching process of the silicon substrate 100 can be performed by two anisotropic and isotropic etching steps so as to form the ink chamber 200, the manifold 210, and the ink channel 220, all of which have more uniform and precise numeric values. That is, as shown in FIG. 14E, after forming a photoresist pattern PR exposing some of the center portion of the opening 150 for an ink chamber and the opening 160 for a manifold on the resultant material of FIG. 14C, an anisotropic etch is performed on the substrate 100 by a predetermined depth to form holes 180 and 190, respectively. The anisotropic etch may use dry etching assisted by inductively coupled plasma, and reactive ion etching (RIE). Next, the photoresist pattern PR is removed followed by an isotropic etch of the exposed silicon substrate 100 as described above to achieve the structure as shown in FIG. 14D. Of course, since the etch rate of the substrate 100 varies depending on the difference in the aperture width of the openings 150, 160, and 170, both the etching steps are not necessarily required.

Figure 14F:
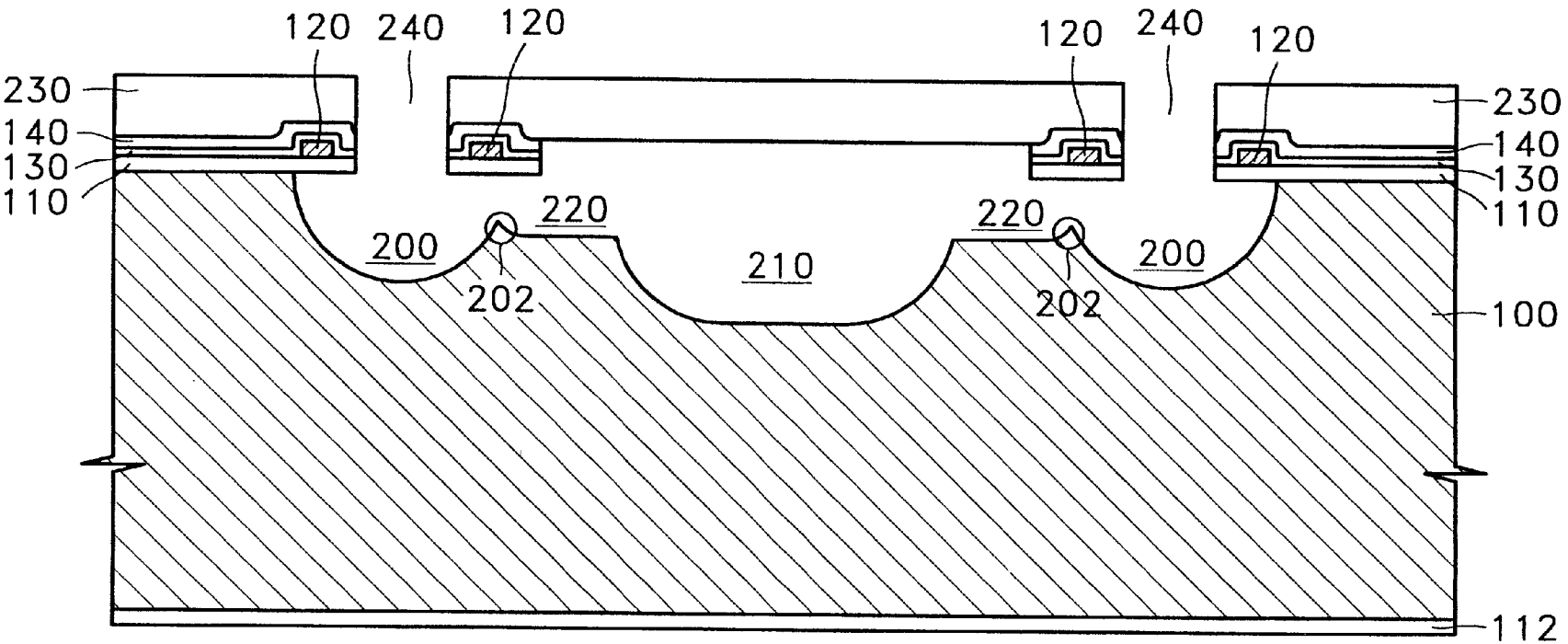

Finally, as shown in FIG. 14F, a heat resistant polymer film such as polyimide is attached on the entire surface of the resultant material of FIG. 14D to form a protective layer 230 and a nozzle 240 is perforated to complete the printhead according to the first embodiment of the invention. Specifically, a polyimide film having a thickness of 15–20 $\mu$m is attached by applying heat or pressure on the substrate 100. As a result, the openings 150, 160, and 170 for forming the ink chamber 200, the manifold 210, and the ink channel 220, respectively, are all covered. A film type layer of polyimide 230 is attached to the oxide layer 140. Because the film type polyimide cannot flow, the polyimide does not fall into manifold 210. After the polyimide is attached, some of the polyimide is removed by laser cutting. The nozzle 240 is then formed with a diameter of about 16–18 $\mu$m in the protective layer 230 using an excimer laser. In this case, the protective layer 230 may serve as a flexible PCB as well, on which a power supply and wiring lines are formed for driving each ink ejector.

Figure 15A:
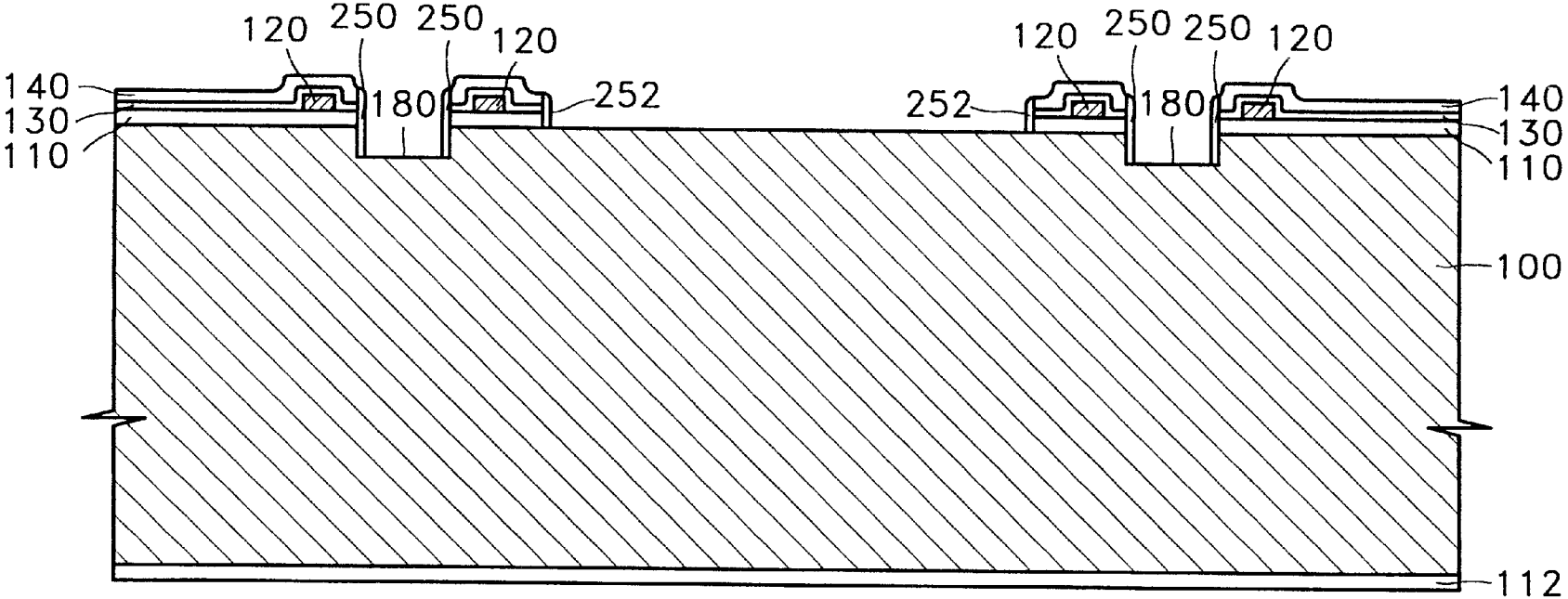
FIGS. 15A and 15B are cross-sectional views showing a process of manufacturing a bubble-jet type ink jet printhead according to another embodiment of the present invention.
Figure 15B:
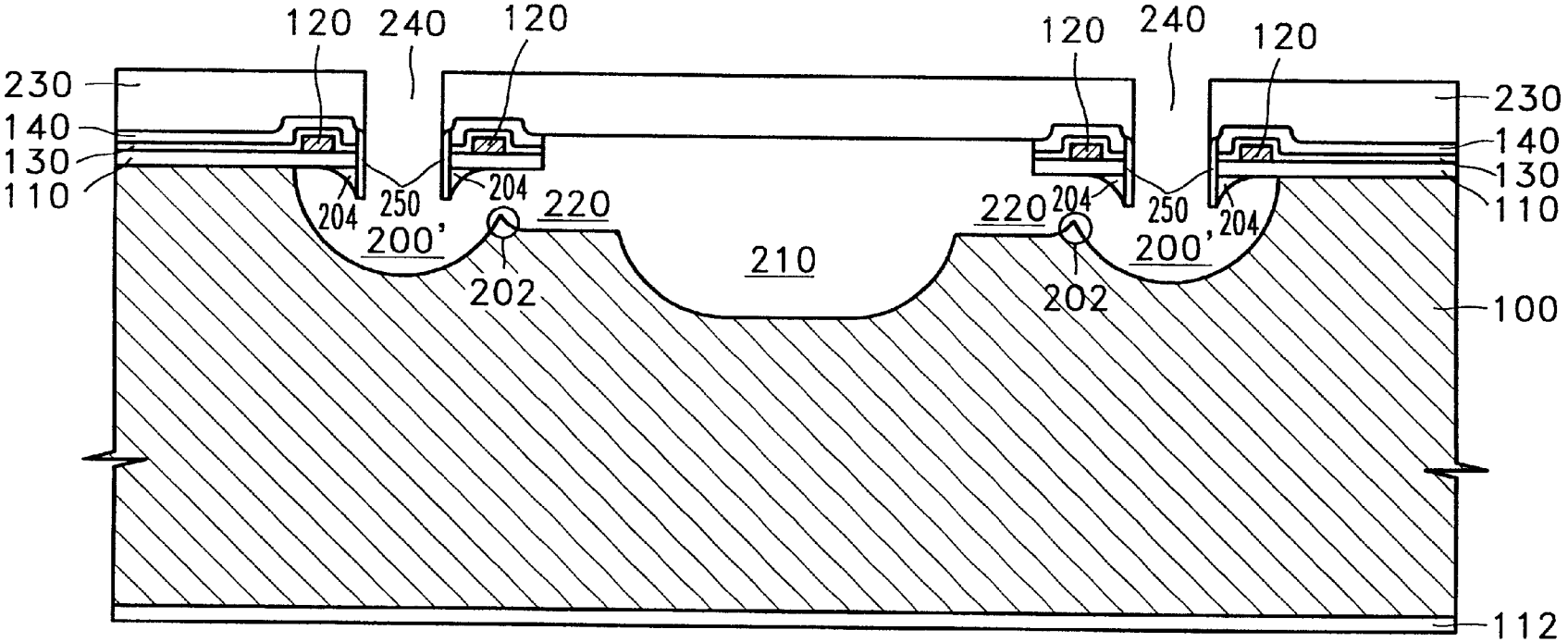

FIGS. 15A and 15B are cross-sectional views showing a method of manufacturing the printhead (See FIG. 7C) according to another embodiment of the present invention. The manufacturing method is performed in the same manner as in FIGS. 14C–14F, and the steps as shown in FIGS. 15A and 15B are further performed.

Specifically, after forming a photoresist pattern (not shown) exposing only the opening 150 of an ink chamber over the entire surface of the resultant material of FIG. 14C, the substrate 100 is etched by a predetermined depth to form a hole 180. Subsequently, following removal of the photoresist pattern, a spacer 250 is formed along a sidewall of the hole 180. Specifically, a predetermined material layer such as a TEOS oxide layer is deposited to a thickness of about 1 $\mu$m over the entire surface of the substrate 100 on which the hole 180 has been formed, and an anisotropic etch is performed on the TEOS oxide layer until the silicon substrate 100 is exposed, as a result of which the hole 180, and the spacers 250 and 252 along the sidewalls of the opening 160 for a manifold and the opening 170 of an ink channel are formed.

In a state as shown in FIG. 15A, isotropic etching is performed on the exposed silicon substrate 100 to form an ink chamber 200' in which a bubble guide 204 and a droplet guide 250 are formed on the edges of the nozzle 240, a manifold 210, and an ink channel as shown in FIG. 15B. Finally, the protective layer 230 is formed and the nozzle 240 is perforated to complete the printhead according to the second embodiment of the invention.

Meanwhile, if the manufacturing methods according to the above embodiments applies to the printhead (See FIGS. 10–13) according to a third embodiment of the invention, the printhead can be manufactured in substantially the same manner except that the opening 170 for an ink chamber is not formed, and thus a detailed explanation will be omitted.

Although this invention has been described with reference to preferred embodiments thereof, it will be understood by those skilled in the art that various changes in form and details may be made therein. For example, materials forming the elements of the printhead according to the invention may not be illustrated ones. That is, the substrate 100 may be comprised of a different material having good processibility instead of silicon, and it is true of the heater 120, the electrode 125, the silicon oxide layer, or nitride layer. Furthermore, the stacking and formation method of each material layer are only examples, and thus a variety of deposition and etching techniques may be adopted therein. Along with this, specific numeric values illustrated in each step may be modified within a range in which the manufactured printhead operates normally.

As described above, according to this invention, the bubble is doughnut-shaped thereby preventing a back flow of ink and avoiding the cross-talk with another ink ejector. The ink chamber is hemispherical, the ink channel is shallower than the ink chamber, and the bubble keeping portion projects at the connection portion of the ink chamber and the ink channel, thereby also preventing a back flow of ink.

The ink chamber, connection of the ink chamber with the manifold, and the shape of the heater in the printhead according to the invention eventually provides a high response rate and high driving frequency. Furthermore, the doughnut-shaped bubble coalesces in the center to prevent the formation of satellite droplets.

Meanwhile, the printhead according to the second embodiment of the invention allows the droplets to be ejected exactly perpendicularly to the substrate by forming the bubble guide and the droplet guide on the edges of the nozzle.

Furthermore, a printhead manufacturing method according to the invention can be simplified by forming the ink chamber and the manifold on the same surface of a substrate, and integrating the nozzle plate and the ring-shaped heater with the substrate. In addition, the manufacturing method according to this invention is compatible with a typical manufacturing process for a semiconductor device, thereby facilitating high volume production.

What is claimed is:

1. A method of manufacturing a bubble-jet type ink jet printhead, the method comprising the steps of:

forming an insulating layer on the surface of a substrate;

forming a round-shaped heater on the insulating layer;

forming electrodes electrically connected with the round-shaped heater on the insulating layer;

etching said insulating layer to form a opening for an ink chamber and an opening for a manifold, said opening for said ink chamber having a diameter less than that of said round-shaped heater and being located inside said round-shaped heater, said opening for said manifold being located outside said round-shaped heater;

etching said substrate using said insulating layer having said openings as an etch mask to form an ink chamber having a diameter greater than that of the round-shaped heater wherein said ink chamber resulting in a concave shape, and said manifold; and depositing a protective layer over said insulating layer, said protective layer covering said opening for said manifold, said protective layer being perforated by a hole, said hole overlapping said opening in said insulating layer for said ink chamber producing a nozzle hole.

2. The method of claim 1, wherein the step of etching the substrate comprises the steps of:

performing an anisotropic etch on said substrate to a predetermined depth using the insulating layer in which said opening for an ink chamber and said opening for a manifold as an etch mask; and performing an isotropic etch on the substrate.

3. The method of claim 1, wherein, said step of etching said insulating layer achieves an opening in said insulating layer that is wider than said resulting manifold while said opening in said insulating layer is entirely outside said heaters, allowing said step of etching said substrate to produce an ink channel in addition to a manifold and ink chamber, said ink channel connecting said ink chamber with said manifold as said substrate from said ink chamber through to said manifold is recessed as a result of said etching step.

4. The method of claim 3, wherein said opening in said insulating layer for said ink chamber is elliptic.

5. The method of claim 3, wherein said opening in said insulating layer for said ink chamber is circular.

6. The method of claim 1, between the steps of etching the insulating layer and etching the substrate, further comprising the steps of:

forming an etch mask exposing said opening for an ink chamber on the insulating layer;

performing an anisotropic etch on the substrate exposed by the etch mask and the insulating layer by a predetermined depth to form a hole;

removing the etch mask; and forming a spacer along a sidewall of the hole.

7. The method of claim 1, wherein the substrate is comprised of silicon.

8. The method of claim 1, wherein the insulating layer is formed by oxidizing the surface of the silicon substrate.

9. The method of claim 1, wherein the heater is comprised of either polycrystalline silicon doped with impurities or a Ta—Al alloy.

10. The method of claim 1, wherein the protective layer is comprised of a polyimide film.

11. The method of claim 1, said opening for said ink chamber and said opening for said manifold being formed simultaneously in a single etch step.

12. The method of claim 1, said manifold and said ink chamber being formed simultaneously in a single etch step.

13. The method of claim 1, said protective layer serving as a nozzle plate, said hole serving as a nozzle hole.

14. The method of claim 1, said manifold and said ink chamber being formed on a same side of said substrate.

15. A method of manufacturing a bubble-jet type ink jet printhead, the method comprising the steps of:

forming an insulating layer on the surface of a substrate;

forming a round-shaped heater on the insulating layer;

etching, via a first etch, said insulating layer to expose said substrate at a first area for an ink chamber and a second area next to the first area for a manifold using simultaneously;

etching, via a second etch, said substrate using said insulating layer having said exposed substrate areas as an etch mask to form said manifold and said ink chamber simultaneously underneath where said second exposed area and said first exposed area of said substrate existed, said manifold and said ink chamber being etched into a same side of said substrate; and depositing a protective layer over said insulating layer, said protective layer covering an opening for said manifold and covering an opening for said ink chamber, said protective layer being perforated by a hole, said hole being disposed over a center of said ink chamber.

16. The method of claim 15, said second etch comprising an isotropic etch.

17. The method of claim 15, said second etch being an anisotropic etch followed by an isotropic etch.

18. The method of claim 15, said substrate being absent of an unetched portion between said ink chamber and said manifold.

19. The method of claim 18, said substrate having a lip where said ink chamber joins said manifold, said lip being shaped to prevent a bubble formed within said ink chamber from expanding into said manifold.

20. The method of claim 15, said second etch producing an ink channel in said substrate that joins said manifold with said ink chamber.

21. The method of claim 15, said ink chamber being hemispherical.

22. The method of claim 15, further comprising the step of forming a spacer that is an extension of said hole downward into said ink chamber.

* * * * *